US007794553B2

(12) United States Patent
Duan et al.

(10) Patent No.: US 7,794,553 B2
(45) Date of Patent: Sep. 14, 2010

(54) THERMOPLASTICALLY PROCESSABLE AMORPHOUS METALS AND METHODS FOR PROCESSING SAME

(75) Inventors: Gang Duan, Chandler, AZ (US); William L. Johnson, Pasadena, CA (US); Aaron Wiest, Los Angeles, CA (US)

(73) Assignee: California Institute of Technology, Pasadena, CA (US)

( * ) Notice: Subject to any disclaimer, the term of this patent is extended or adjusted under 35 U.S.C. 154(b) by 334 days.

(21) Appl. No.: 11/952,694

(22) Filed: Dec. 7, 2007

(65) Prior Publication Data

US 2008/0135138 A1 Jun. 12, 2008

Related U.S. Application Data

(60) Provisional application No. 60/873,515, filed on Dec. 7, 2006, provisional application No. 60/881,960, filed on Jan. 23, 2007, provisional application No. 60/923,221, filed on Apr. 13, 2007.

(51) Int. Cl.
*C22C 45/10* (2006.01)

(52) U.S. Cl. ..... 148/403; 148/421

(58) Field of Classification Search ..... 148/403
See application file for complete search history.

(56) References Cited

U.S. PATENT DOCUMENTS 5,209,791 A 5/1993 Masumoto et al.
5,288,344 A 2/1994 Peker et al.
6,027,586 A 2/2000 Masumoto et al.
6,709,536 B1 * 3/2004 Kim et al. ..... 148/561
6,771,490 B2 * 8/2004 Peker et al. ..... 361/679.34
7,017,645 B2 3/2006 Johnson et al.

OTHER PUBLICATIONS

Schroers et al., "Highly processable bulk metallic glass-forming alloys in the Pt-Co-Ni-Cu-P system", Applied Physics Letters, May 3, 2004, vol. 84, No. 18, pp. 3666-3668.

Xu et al, "Unusual Glass-Forming Ability of Bulk Amorphous Alloys Based on Ordinary Metal Copper", Physical Review Letters, Jun. 18, 2004, vol. 92 No. 24, pp. 245504-1-245504-4.

Schroers, "The Superplastic Forming of Bulk Metallic Glasses", JOM, May 2005, pp. 35-39.

Fan et al., "Viscous flow of the $Pd_{43}Ni_{10}Cu_{27}P_{20}$ bulk metallic glass-forming liquid", Applied Physics Letters, Jan. 26, 2004, vol. 84, No. 4, pp. 487-489.

(Continued)

*Primary Examiner*—George Wyszomierski
(74) *Attorney, Agent, or Firm*—Kauth, Pomeroy, Peck & Bailey LLP

(57) ABSTRACT

High strength, thermoplastically processable (TPF) amorphous alloys composed of Beryllium and at least one ETM and at least one LTM, as well as methods of processing such alloys are provided. The TPF alloys of the invention demonstrate good glass forming ability, low viscosity in the supercooled liquid region (SCLR), a low processing temperature, and a long processing time at that temperature before crystallization.

29 Claims, 13 Drawing Sheets

| | | Temp | Time to Crystallize | Viscosity |
|---|---|---|---|---|
| $Zr_{35}Ti_{30}Cu_{7.5}Be_{27.5}$ | 1- | 410C | 605s | $6.5*10^4$Pa-s |
| | 2- | 420C | 300s | $5.0*10^4$Pa-s |
| $Zr_{44}Ti_{11}Cu_{10}Ni_{10}Be_{25}$ | 3- | 440C | 600s | $5.8*10^5$Pa-s |
| | 4- | 450C | 400s | $4.5*10^5$Pa-s |

OTHER PUBLICATIONS

Greer, "Metallic Glasses", Science, New Series, Mar. 31, 1995, vol. 267, No. 5206, pp. 1947-1953.
Kato et al., "Fragility and thermal stability of Pt- and Pd-based bulk glass forming liquids and their correlation with deformability", Scripta Materialia, 2006, vol. 54, pp. 2023-2027.
Bakke et al., "The viscosity of the $Zr_{46.75}Ti_{8.25}Cu_{7.5}Ni_{10}Be_{27.5}$ bulk metallic glass forming alloy in the supercooled liquid", Appl. Phys. Lett., Nov. 27, 1995, vol. 67, No. 22, pp. 3260-3262.
Lee et al., "Extrusion formability and deformation behavior of $Zr_{41.2}Ti_{13.8}Cu_{12.5}Ni_{10}Be_{22.5}$ bulk metallic glass in an undercooled liquid state after rapid heating", Materials Science and Engineering, 2005, A 399, pp. 238-243.
Inoue, "Stabilization of Metallic Supercooled Liquid and Bulk Amorphous Alloys", Acta. mater., 2000, vol. 48, pp. 279-306.
Lu et al., "Structural Amorphous Steels", Physical Review Letters, Jun. 18, 2004, vol. 92, No. 24, pp. 244503-1-245503-4.
Mukherjee et al., "Overheating threshold and its effect on time-temperature-transformation diagrams of zirconium based bulk metallic glasses", Applied Physics Letters, Jun. 14, 2004, vol. 84, No. 24, pp. 5010-5012.
Schroers et al., "Amorphous Metal Alloys Form Like Plastics", Advanced Materials & Processes, Jan. 2006, pp. 61-63.
Ponnambalam et al., "Fe-based metallic glasses with diameter thickness larger than one centimeter", J. Mater. Res., May 2004, vol. 19, No. 5, pp. 1320-1323.
Schroers et al., "Gold based bulk metallic glass", Applied Physics Letters, 2005, 87, pp. 061912-1-061912-3.
Peker et al., "A highly processable metallic glass: $Zr_{41.2}Ti_{13.8}Cu_{12.5}Ni_{10.0}Be_{22.5}$", Appl. Phys. Lett., Oct. 25, 1993, vol. 63, No. 17, pp. 2342-2344.
Schroers et al. ,"Blow molding of bulk metallic glass", Scripta Materialia, 2007, vol. 57, pp. 341-344.
Shibata et al, "Isothermal Evolution of Long Range Order in Bulk Metallic Glass $Ni_{15}Pt_{60}P_{25}$near Glass Transition: In-Situ SANS Measurement", Progress of Theoretical Physics Supplement, No. 126, 1997, pp. 75-78.
Waniuk et al., "Timescales of crystallization and viscous flow of the bulk glass-forming Zr-Ti-Ni-Cu-Be alloys", Physical Review B, 2003, 67, pp. 184203-1-184203-9.
Zhang et al., "Amorphous Metallic Plastic", Physical Review Letters, May 27, 2005, PRL 94, pp. 205502-1-205502-4.
Busch et al., "The kinetic glass transition of the $Zr_{46.75}Ti_{8.25}Cu_{7.5}Ni_{10}Be_{27.5}$ bulk metallic glass former-supercooled liquids on a long time scale", Applied Physics Letters, May 25, 1998, vol. 72, No. 21, pp. 2695-2697.
Chu et al, "Nanoimprint of gratings on a bulk metallic glass", Applied Physics Letters, 2007, vol. 90, pp. 034101-1-034101-3.
Demetriou et al., "A free-Vol. model for the rheology of undercooled $Zr_{41.25}Ti_{13.75}Cu_{12.5}Ni_{10}Be_{22.5}$ liquid", Scripta Materialia, 2005, vol. 52, pp. 833-837.
Masuhr et al., "Time Scales for Viscous Flow, Atomic Transport, and Crystallization in the Liquid and Supercooled Liquid States of $Zr_{41.2}Ti_{13.8}Cu_{12.5}Ni_{10.0}Be_{22.5}$", Physical Review Letters, Mar. 15, 1999, vol. 82, No. 11, pp. 2290-2293.
Lu et al., "Deformation behavior of the $Zr_{41.2}Ti_{13.8}Cu_{12.5}Ni_{10}Be_{22.5}$ bulk metallic glass over a wide range of strain-rates and temperatures", Acta Materialia, 2003, vol. 51, pp. 3429-3443.
Mukherjee et al., "Viscosity and specific Vol. of bulk metallic glass-forming alloys and their correlation with glass forming ability", Acta Materialia, 2004, vol. 52, pp. 3689-3695.
Saotome et al., "The micro-nanoformability of Pt-based metallic glass and the nanoforming of three-dimensional structures", Intermetallics, 2002, vol. 10, pp. 1241-1247.
Waniuk, et al., "Critical cooling rate and thermal stability of Zr-Ti-Cu-Ni-Be alloys", Applied Physics Letters, Feb. 26, 2001, vol. 78, No. 9, pp. 1213-1215.
Johnson et al., "Rheology and Ultrasonic Properties of Metallic Glass-Forming Liquids: A Potential Energy Landscape Perspective", MRS Bulletin, Aug. 2007, vol. 32, pp. 644-650.
Guo et al., "Ductile titanium-based glassy alloy ingots", Applied Physics Letters, 2005, vol. 86, pp. 091907-1-091907-3.

* cited by examiner

| | | Temp | Time to Crystallize | Viscosity |
|---|---|---|---|---|
| $Zr_{35}Ti_{30}Cu_{7.5}Be_{27.5}$ | 1- | 410C | 605s | $6.5*10^4$Pa-s |
| | 2- | 420C | 300s | $5.0*10^4$Pa-s |
| $Zr_{44}Ti_{11}Cu_{10}Ni_{10}Be_{25}$ | 3- | 440C | 600s | $5.8*10^5$Pa-s |
| | 4- | 450C | 400s | $4.5*10^5$Pa-s |

1. Empty Mold

2. Molten alloy injected and outside shell freezes first

3. Built-up negative pressure causes cavitation of a pore

THERMOPLASTICALLY PROCESSABLE AMORPHOUS METALS AND METHODS FOR PROCESSING SAME

CROSS-REFERENCE TO RELATED APPLICATIONS

The current invention claims priority to U.S. Provisional Application No. 60/873,515, filed Dec. 7, 2006, U.S. Provisional Application No. 60/881,960, filed Jan. 23, 2007, and U.S. Provisional Application No. 60/923,221, filed Apr. 13, 2007, the disclosures of each of which are incorporated herein by reference.

STATEMENT OF FEDERAL RIGHTS

The U.S. Government has certain rights in this invention pursuant to Grant No. DMR0520565 awarded by the National Science Foundation.

FIELD OF THE INVENTION

The current invention is directed to high strength amorphous alloys that can be thermoplastically processed to make material parts and articles, and methods of thermoplastically processing such amorphous alloys.

BACKGROUND OF THE INVENTION

Over the last two decades metallic glasses (MGs) have received increasing attention because of their unique characteristics, such as high strength, high specific strength, large elastic strain limit, excellent wear and corrosion resistance, along with other remarkable engineering properties. (For further discussion see, e.g., A. L. Greer, *Science* 1995, 267, 1947; W. L. Johnson, *MRS Bulletin* 1999, 24, 42; A. Inoue, *Acta Materialia* 2000, 48, 279; D. H. Xu, G. Duan, and W. L. Johnson, *Physical Review Letters* 2004, 92, 245504; V. Ponnambalam, et al., *Journal of Materials Research* 2004, 19, 1320; and Z. P. Lu, C. T. Liu, J. R. Thompson, W. D. Porter, *Physical Review Letters* 2004, 92, 245503, the disclosures of which are incorporated herein by reference.) Because of the promise shown by these materials, researchers have designed a multitude of multi-component systems that form amorphous glassy alloys, among which Zr— (U.S. Pat. No. 5,288, 344, referred to as Vit1 series of alloys, the disclosure of which is incorporate herein by reference) bulk metallic glasses (BMGs) have been utilized commercially to produce a variety of items, including, for example, sporting goods, electronic casings, and medical devices.

Most practical applications of MGs demand near-net-shaping process in manufacturing. However, conventional die casting, the common technique for net-shape processing of metals, requires fast cooling to bypass the crystallization of most MGs during solidification. This fast cooling requirement limits the ability to make pieces of large cross-section (i.e., limited by critical casting thickness), limits the ability to make parts with high aspect ratios (i.e., with large thin walls), and limits the ability to make high quality casts or to manufacture structures with complex geometries. Nevertheless, the properties of these MGs, including their high glass forming ability, good processability, large supercooled liquid region (SCLR), and a viscosity that varies continuously and predictably in the supercooled liquid region continues to hold out the promise that they could be processed thermoplastically if suitable candidate materials can be identified.

The unique advantages of injection molding, blow molding, micro-replication, and other thermoplastic technologies are largely responsible for the widespread uses of plastics such as polyethylene, polyurethane, PVC, etc., in a broad range of engineering applications. Powder Injection Molding (PIM) of metals represents an effort to apply similar processing to metals, but requires blending of the powder with a plastic binder to achieve net shape forming and subsequent sintering of the powder. Given suitable materials, thermoplastic forming (TPF) would be the method of choice for manufacturing of metallic glass components because TPF decouples the forming and cooling steps by processing glassy material at temperatures above the glass transition temperature ($T_g$) and below the crystallization temperature ($T_x$) followed by cooling to ambient temperature. (See, e.g., J. Schroers, *JOM* 2005, 57, 35; and J. Schroers, N. Paton, *Advanced Materials & Processes* 2006, 164, 61, the disclosures of which are incorporated herein by reference.)

Thermoplastic forming (TPF) of MGs is a net-shaping processing method taking place in the supercooled liquid region of such materials, which is the temperature region in which the amorphous material first relaxes into a viscous metastable liquid before crystallization. Operating in this supercooled liquid region, TPF decouples the fast cooling and forming of MG parts and allows for the replication of small features and thin sections of metals with high aspect ratios. TPF has several advantages over conventional die casting, including smaller solidification shrinkage, less porosity of the final product, more flexibility on possible product sizes, a robust process that does not sacrifice the mechanical properties of the material, and no cooling rate constraints on the thickness of parts that can be rendered amorphous (critical casting thickness).

From a processing point of view, MG alloys with an extremely large supercooled liquid region (excellent thermal stability against crystallization), which can provide lower processing viscosities and exhibit smaller flow stress, would be desirable for use in conjunction with a TPF process. In addition, excellent glass forming ability and low glass transition temperature ($T_g$) are also preferred to thermoplastically process MGs. Unfortunately, among the published metallic glasses, only the expensive Pt-, and Pd-based glasses have shown good thermoplastic formability. (See, e.g., J. Schroers, W. L. Johnson, *Applied Physics Letters* 2004, 84, 3666; G. J. Fan, et al., *Applied Physics Letters* 2004, 84, 487; and J. P. Chu, et al., *Applied Physics Letters* 2007, 90, 034101, the disclosures of which are incorporated herein by reference.) Zr-based metallic glasses, especially the Vitreloy series, are much less expensive than Pt- and Pd-based alloys, have exceptional glass forming ability, but they are usually strong liquids (the drop of viscosity with temperature is not steep) and low processing viscosities are unattainable in the supercooled liquid region (SCLR) between $T_g$ and $T_x$. (See, e.g., A. Masuhr, et al., *Physical Review Letters* 1999, 82, 2290; R. Busch, W. L. Johnson, *Applied Physics Letters* 1998, 72, 2695; F. Spaepen, *Acta Metallurgica* 1977, 25, 407; and J. Lu, G. Ravichandran, W. L. Johnson, *Acta Materialia* 2003, 51, 3429, the disclosures of which are incorporated herein by reference.) One exception to this general rule is Vit1b ($Zr_{44}Ti_{11}Cu_{10}Ni_{10}Be_{25}$); however, even this allow only provides accessible viscosities of ~10^Pa-s, substantially higher than the viscosities needed to access most thermoplastic forming techniques. (See, Schroers, J., et al. *Scripta Materialia,* 2007, 57, 341-344.1

Accordingly, a need exists for a new family of inexpensive MGs that can be incorporated into a thermoplastic processing application.

SUMMARY OF THE INVENTION

The current invention is directed to a new class of amorphous alloys that can be thermoplastically processed to make material parts and articles, and methods of thermoplastically processing such amorphous alloys.

The current invention is directed to BMG alloy compositions comprising beryllium, at least one ETM, and at least one LTM, and to methods of forming such BMG alloy compositions where at a heating rate of 20 K/min the alloy has a $\Delta T$ of at least 135 K and a viscosity that falls below a value of less than about $10^5$ Pa-s. In one such an embodiment the composition is in accordance with the equation:

$$(Zr_xTi_{(1-x)})_{a1}ETM_{a2}CU_{b1}LTM_{b2}Be_c,$$

where x is an atomic fraction and a1, a2, b1, b2, and c are atomic percentages, and where (a1+a2) falls within the range of 60 to 80% and x is in the range of 0.05 to 0.95; and In one embodiment, the invention is directed to quaternary BMG compositions having a base composition of Be—Ti—Zr—Cu. In such an embodiment up to 15% of the Ti or Zr can be substituted with another element. In one such embodiment the additional element is an early transition metal. Also, in such an embodiment, Cu can be substituted with another late transition metal, such as Fe or Co.

In another embodiment of the invention the ternary BMGs in accordance with the current invention readily form an amorphous phase upon cooling from the melt at a rate less than $10^3$ K/s.

The above-mentioned and other features of this invention and the manner of obtaining and using them will become more apparent, and will be best understood, by reference to the following description, taken in conjunction with the accompanying drawings. The drawings depict only typical embodiments of the invention and do not therefore limit its scope.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1A:
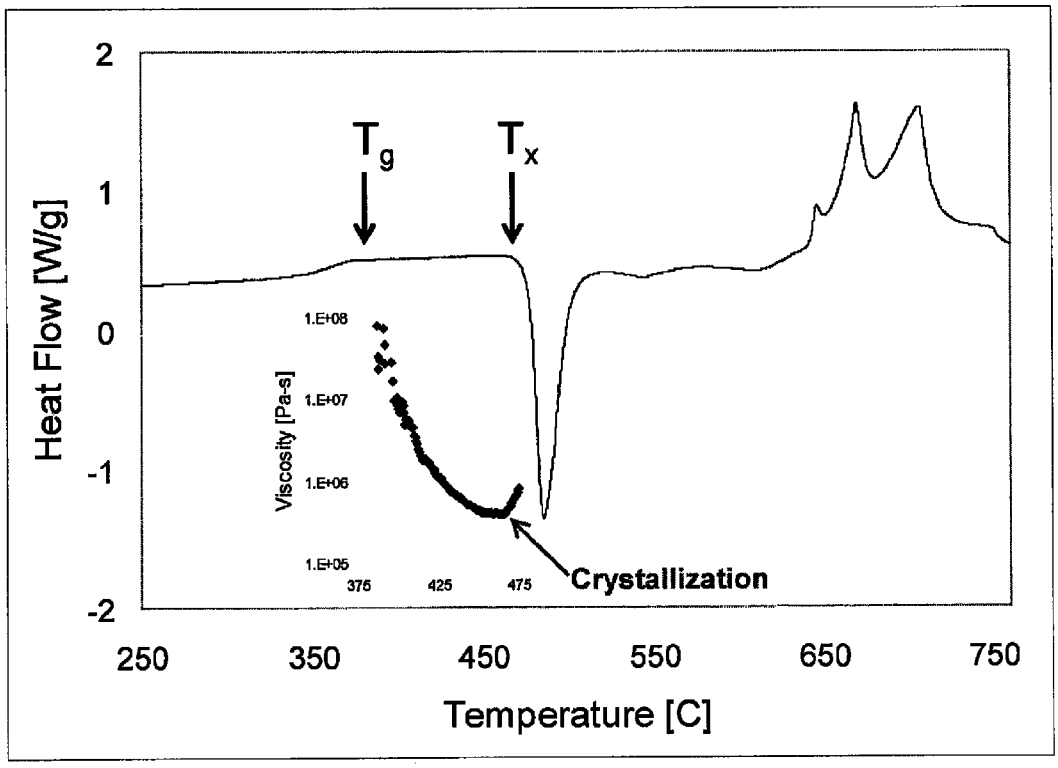
FIG. 1*a* provides an overlay of a DSC scan and a viscosity curve of the supercooled liquid region of a conventional amorphous alloy.

In general terms, the current invention is directed to producing a new class of high strength, thermoplastically processable amorphous alloys, which in the broadest terms are composed of Beryllium and at least one ETM and LTM. The materials of the current invention possess a unique combination of properties including, low density, viscosities in the thermoplastic zone (at least one order of magnitude lower than that of the commercialized Zr-based alloys and lower also to the viscosity of Pd-based metallic glass and approaching the viscosities attainable in polymer glasses), high thermal stability (up to 165 K), low $T_g$ (about 300° C.), and good glass forming ability (critical casting thickness at least 15 mm). As a result of these unique property combinations, these alloys demonstrate good thermoplastic processability, and combined with their excellent mechanical properties, these alloys are appropriate for use in a number of applications, including microelectromechanical systems, nano- and microtechnology, and medical and optical applications. Moreover, the large supercooled liquid region offered by these unique alloys in the current invention enables Newtonian flow conditions at strain rates higher than those of a conventional metallic glass with a smaller supercooled liquid region. This capability can be utilized for more efficient wire/fiber/plate/sheet drawing process.

DEFINITIONS

Early Transition Metal (ETM): For purposes of this invention, early transition metals are defined as elements from Groups 3, 4, 5 and 6 of the periodic table, including the lanthanide and actinide series. The previous IUPAC notation for these groups was IIIA, IVA, VA and VIA.

Late Transition Metal (LTM): For purposes of this invention, late transition metals are defined as elements from Groups 7, 8, 9, 10 and 11 of the periodic table. The previous IUPAC notation was VIIA, VIIIA and IB.

Amorphous Alloys or Metallic Glasses (MGs): For purposes of this invention, metallic glasses are defined as materials which are formed by solidification of alloy melts by cooling the alloy to a temperature below its glass transition temperature before appreciable homogeneous nucleation and crystallization has occurred.

Thermoplastic Processing (TPF): For the purposes of this invention, thermoplastic processing/forming is defined as a processing technique for forming metallic glasses in which the metallic glass is held at a temperature in a thermoplastic zone, which is below $T_{nose}$ (the temperature at which crystallization of the amorphous alloy occurs on the shortest time scale, which means that the resistance of crystallization is minimum) and above $T_g$ (the glass transition temperature) during the shaping or molding step, followed by a quenching step where the item is cooled to the ambient temperature.

Extruding: For the purposes of this invention, extruding is defined as either to force, press, or push out; or to shape (as metal or plastic) by forcing through a die.

Injection molding: For the purposes of this invention, injection molding is defined as a method of forming articles (as of plastic) by heating the molding material to a temperature within the SCLR until it can flow and injecting it into a mold.

Discussion of TPF Alloys

Figure 1B:
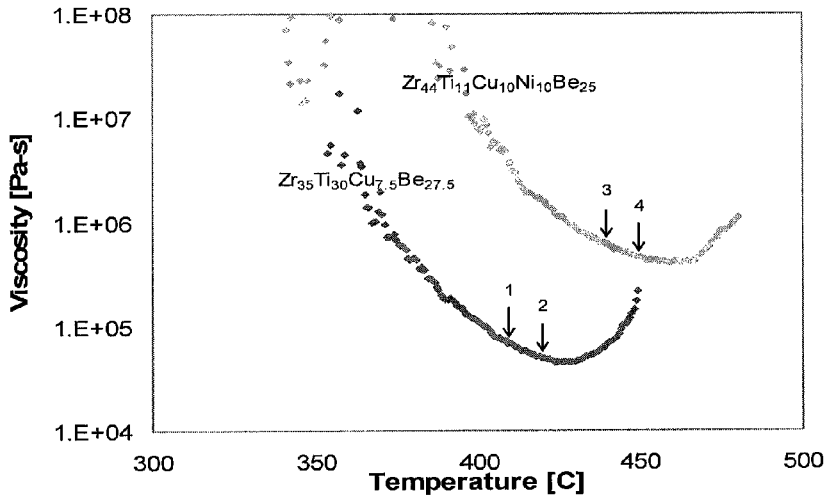
FIG. 1*b* provides a data graph comparing the viscosities of a conventional amorphous alloy and an exemplary alloy in accordance with the current invention.

As discussed previously, one of the major limitations faced in forming conventional amorphous alloys is the small processing window available before crystallization, and the relatively high viscosity of the material within that processing window. Forming processes for these materials are further complicated by the interrelation between the viscosity of the alloy and the temperature at which the alloy crystallizes. To demonstrate this FIG. 1*a* provides an overlay of a DSC scan and a viscosity curve for one of the best conventional amorphous alloy showing how viscosity drops in the supercooled liquid region until crystallization. As shown, for these materials the lowest viscosities are accessible close to Tx. (Note that in FIG. 1*a* the viscosity curve (inset) is aligned with the temperature scale from the DSC curve.) Unfortunately, in most amorphous alloys the supercooled region is such that the viscosity remains too high for most thermoplastic processing techniques at temperatures that allow the material to retain its amorphous character. For example, typically metallic glass viscosity ~10^7 Pa-s whereas polymers are injection molded at ~10^3 Pa-s. In contrast, the viscosity of an exemplary alloy of the current invention ($Zr_{35}Ti_{30}Cu_{7.5}Be_{27.5}$) when measured at a heating rate of 20 K/min is less than about 10^5 Pa-s, two orders of magnitude lower than conventional amorphous materials, as shown in FIG. 1*b*.

The strain rate sensitivity for the Vitreoy alloys has been extensively studied (J. Lu, G. Ravichandran, W. L. Johnson, *Acta Materialia* 2003, 51, 3429, the disclosure of which are incorporated herein by reference). As is known from follow-up analysis of the same experimental data, higher thermal stability of the supercooled liquid can lead to a substantial increase of the strain rate limit for Newtonian flow. Specifically, it has been shown that if the supercooled liquid can remain stable at 135 K above the glass transition temperature, at least 5 orders of magnitude increase in the strain rate limit for Newtonian flow can be realized. (See, M. D. Demetriou, and W. L Johnson, Scripta Materialia, 2005, 52, 833, the disclosure of which are incorporated herein by reference.) Newtonian flow conditions are necessary and important for applications involving tensile loading, such as wire/fiber/plate/sheet drawing. Non-Newtonian flow gives rise to shear thinning that leads to necking and cessation of the process. Therefore, a high strain rate capability while maintaining Newtonian flow can enable a more efficient drawing process.

In general terms, the current invention is directed to producing high strength, thermoplastically processable (TPF) amorphous alloys which are composed of Beryllium and at least one ETM and at least one LTM. An alloy optimal for TPF would have good glass forming ability, low viscosity in the SCLR, a low processing temperature, and a long processing time at that temperature before crystallization. It has been found that Be-bearing Zr—Ti based quaternary metallic glasses having compositions that fall within the range of 60%<Zr+Ti<, 80% have Lower $T_g$, and increased SCLR in comparison with conventional bulk solidifying amorphous alloys such as the Vitreloy alloys (Zr+Ti=55%).

More specifically, the amorphous alloys of the current invention comprise Beryllium and at least one ETM and at least one LTM in accordance with the formula:

$$(Zr_xTi_{(1-x)})_{a1}ETM_{a2}Cu_{b1}LTM_{b2}Be_c,$$

where x is an atomic fraction and a1, a2, b1, b2, and c are atomic percentages, and where (a1+a2) falls within the range of 60 to 80%, x is in the range of 0.05 to 0.95. In addition, it is required that Ni make up no more than a fractional amount of the overall alloy composition, defined herein as less than 5% of the total alloy composition.

In a preferred embodiment of the invention, the alloy formulation may be expressed by the following formulation:

$$Zr_aTi_bCu_cBe_d,$$

and falls within one of the following sub-ranges where a+b+c+d equals 100%:

where a+b>60% with d>15% where a≈b with d>15%; and where a≈5b with d>20%.

Although specific ranges of materials are provided above, it should be understood that variations and modifications to the proposed invention can exist with respect to the composition of amorphous alloys. For example other elements, excluding ETMs and LTMs, can be added to the alloys without significantly altering the base alloy properties. Such materials may include, for example, Sn, B, Si, Al, In, Ge, Ga, Pb, Bi, As and P. In addition, Cu can be substituted with other LTMs such as, for example, Co and Fe, but in any event the concentration of Ni in the alloy cannot exceed 5% of the total alloy composition.

Regardless of the specific compositional substitutions made, the two key distinguishing features of alloys made in accordance with the above formulations are that when heated at a rate of 20 K/min the alloys have supercooled liquid regions of at least 135 K, and that at a heating rate of 20 K/min the alloys have processing viscosities in the supercooled liquid region of less than around 10^5 Pa-s (unprecedentedly low for a metallic glass forming system). Accordingly, the alloys of the current invention exhibit "benchmark" characteristics for thermoplastic processing. Table 1 below, provides a listing of exemplary alloy formulations in accordance with the above ranges along with thermal properties for those alloys.

TABLE 1

Summary of BMG forming alloys investigated in the current invention.

| Materials | $T_g$ | $T_x$ | $T_l$ | ΔT | $T_{rg}$ |
|---|---|---|---|---|---|
| $Zr_{35}Ti_{30}Be_{30}Cu_5$ | 574.9 | 725.3 | 1114.4 | 150.4 | 0.516 |
| $Zr_{35}Ti_{30}Be_{27.5}Cu_{7.5}$ | 574.6 | 739.7 | 1070.7 | 165.1 | 0.537 |
| $Zr_{35}Ti_{30}Be_{26.75}Cu_{8.25}$ | 578.2 | 737.2 | 1044.2 | 159 | 0.554 |
| $Zr_{54}Ti_{11}Be_{22.5}Cu_{12.5}$ | 581 | 721 | 1035 | 140 | 0.561 |
| $Zr_{54}Ti_{11}Be_{17.5}Cu_{17.5}$ | 584 | 722 | 1074 | 138 | 0.544 |
| $Zr_{51}Ti_9Be_{27.5}Cu_{12.5}$ | 595 | 731 | 1042 | 136 | 0.571 |
| $Zr_{51}Ti_9Be_{25}Cu_{15}$ | 592 | 730 | 1047 | 138 | 0.565 |
| $Zr_{40}Ti_{25}Be_{29}Cu_6$ | 579.7 | 728.1 | 1113.1 | 148.4 | 0.521 |
| $Zr_{40}Ti_{25}Be_{27}Cu_8$ | 579.4 | 737.5 | 1080.0 | 158.1 | 0.536 |
| $Zr_{40}Ti_{25}Be_{25}Cu_{10}$ | 579.4 | 743.2 | 1046.9 | 163.8 | 0.553 |
| $Zr_{27.5}Ti_{35}Be_{29.5}Cu_8$ | 590.9 | 728.6 | 1107.5 | 137.7 | 0.534 |
| $Zr_{32.5}Ti_{30}Be_{31.5}Cu_6$ | 590.4 | 739.7 | >1123.2 | 149.3 | <0.526 |

TABLE 1-continued

Summary of BMG forming alloys investigated in the current invention.

| Materials | $T_g$ | $T_x$ | $T_l$ | ΔT | $T_{rg}$ |
|---|---|---|---|---|---|
| $Zr_{32.5}Ti_{30}Be_{29.5}Cu_8$ | 587.7 | 745.1 | 1092.9 | 157.4 | 0.538 |
| $Zr_{32.5}Ti_{30}Be_{27.5}Cu_{10}$ | 587.8 | 747.4 | 1061.2 | 159.6 | 0.554 |
| $Zr_{37.5}Ti_{25}Be_{27.5}Cu_{10}$ | 584.0 | 744.1 | 1080.2 | 160.1 | 0.541 |
| $Zr_{30}Ti_{30}Be_{32}Cu_8$ | 591.2 | 736.0 | 1123.2 | 144.8 | 0.526 |
| $Zr_{30}Ti_{30}Be_{30}Cu_{10}$ | 596.0 | 740.4 | 1046.0 | 144.4 | 0.570 |
| $Zr_{35}Ti_{25}Be_{32}Cu_8$ | 596.5 | 735.4 | 1021.2 | 138.9 | 0.584 |
| $Zr_{35}Ti_{25}Be_{30}Cu_{10}$ | 595.0 | 746.1 | 989.2 | 151.1 | 0.601 |
| $Zr_{35}Ti_{25}Be_{28}Cu_{12}$ | 596.3 | 744.0 | 984.6 | 147.7 | 0.606 |
| $Zr_{40}Ti_{20}Be_{26.25}Cu_{13.75}$ | 589.5 | 740.8 | 1114.7 | 151.3 | 0.529 |
| $Zr_{35}Ti_{30}Be_{33}Co_2$ | 584.3 | 721.0 | 1097.3 | 136.7 | 0.532 |
| $Zr_{35}Ti_{30}Be_{31}Co_4$ | 588.7 | 740.4 | 1075.1 | 151.7 | 0.548 |
| $Zr_{35}Ti_{30}Be_{29}Co_6$ | 597.3 | 749.4 | 1110.5 | 152.1 | 0.538 |
| $Zr_{35}Ti_{30}Be_{33}Fe_2$ | 586.0 | 722.8 | 1100.8 | 136.8 | 0.532 |
| $Zr_{35}Ti_{30}Be_{31}Fe_4$ | 591.7 | 737.8 | 1073.7 | 146.1 | 0.551 |

Although the above discussion has focused on the formulation and properties of the TPF alloy of the current invention, the invention is also directed to novel techniques for forming and shaping such materials. It should be understood as a starting point that the formation of the alloy materials and the shaping of those materials may either be intertwined or separate processes, and in the case where separate processes are used to make the alloy material and then form that material into a final product any suitable process may be used to make the alloy starting material.

For example, in one common process nominal compositions are made into ingots by melting the mixtures in an arc furnace under an inert gas atmosphere. The alloy ingots are then cast into cavities with different shapes within a conductive mold to render the solidified product amorphous. In such an embodiment material parts or articles can be made by thermoplastically processing the amorphous sheets or amorphous starting materials with any suitable thermoplastic processing technique as will be discussed in the following section. It should be understood in reading the following methods that any suitable method of making a feedstock of material may be used, such as, for example, by a drop tower method, etc.

In one embodiment, the method of thermoplastically processing an amorphous alloy may comprise a plastic molding process including the steps of:

providing a quantity of a metallic glass in an amorphous state in the ambient temperature; heating said amorphous alloy directly to an intermediate thermoplastic forming temperature range above $T_g$ and below the $T_{nose}$;

stabilizing the temperature of the amorphous alloy within the intermediate thermoplastic forming temperature range;

shaping the amorphous alloy under a shaping pressure low enough to maintain the amorphous alloy in a Newtonian viscous flow regime and within the intermediate thermoplastic forming temperature for a period of time sufficiently short to avoid crystallization of the amorphous alloy to form a molded part; and cooling the molded part to ambient temperature.

In another embodiment, the method of thermoplastically processing an amorphous alloy may comprise a plastic casting process including the steps of:

providing a quantity of an amorphous alloy in a molten state above the melting temperature of the amorphous alloy ($T_m$);

cooling said molten amorphous alloy directly to an intermediate thermoplastic forming temperature range above $T_g$ and below the $T_{nose}$;

stabilizing the temperature of the amorphous alloy within the intermediate thermoplastic forming temperature range;

shaping the amorphous alloy under a shaping pressure low enough to maintain the amorphous alloy in a Newtonian viscous flow regime and within the intermediate thermoplastic forming temperature for a period of time sufficiently short to avoid crystallization of the amorphous alloy to form a molded part; and cooling the molded part to ambient temperature.

Figure 4:
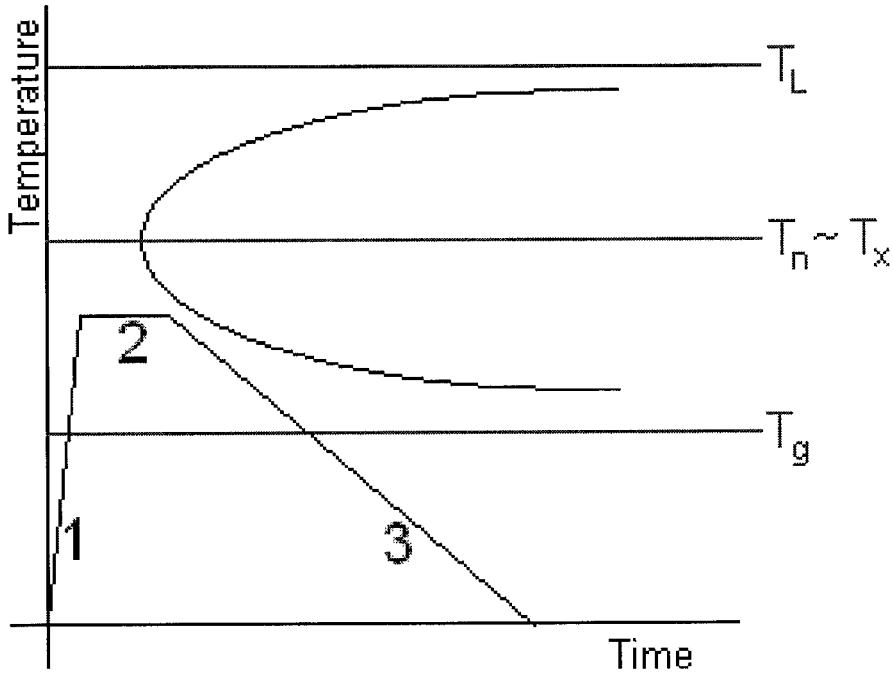
FIG. 4 provides a schematic TTT diagram showing the injection molding processing route described in the current invention.

In still another embodiment, the method of thermoplastically processing an amorphous alloy comprises an injection molding process. For clarity, the steps of this process are overlaid on a TTT diagram in FIG. 4. As shown, the process includes the steps of:

heating/cooling an amorphous feedstock to a temperature between the glass transition temperature, $T_g$, and the crystallization temperature, $T_x$ (FIG. 4, Step 1);

forcing the heated alloy through a restrictive nozzle before entrance into a mold (FIG. 4, Step 2); and cooling the molded part to an ambient temperature (FIG. 4, Step 3).

Figure 5:
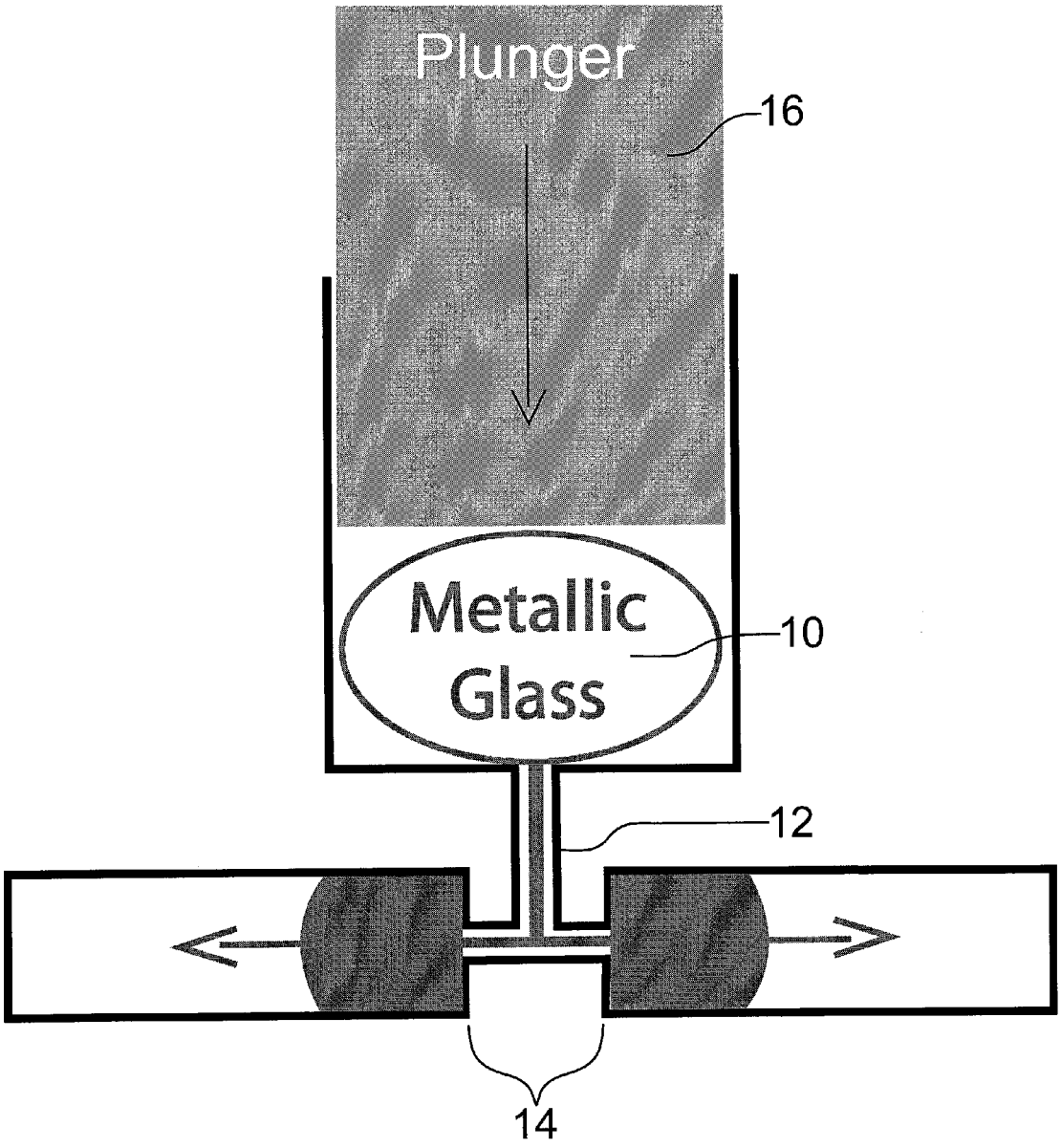
FIG. 5 provides a schematic diagram of an injection molding apparatus in accordance with an exemplary embodiment of the current invention.

The injection molding process requires several additional components including a reservoir for the amorphous feedstock, a method of heating the amorphous metallic feedstock, a method of applying pressure to the material in the reservoir, a gate or gating system, a mold and optionally a method of heating the mold. One exemplary embodiment of such a system is diagrammed schematically in FIG. 5. As shown, a reservoir (10) of molten alloy is attached via a gate and nozzle (12) to a mold (14). A pressure, in this case via a plunger mechanism (16) is then applied to the alloy in the reservoir to inject it through the gate/nozzle into the mold.

Although any suitable method of heating the amorphous feed stock may be used with the injection molding process of the current invention, some exemplary methods include, but are not limited to an RF power supply and coil, a cartridge heater, and a furnace.

Likewise, suitable methods of applying pressure to the material in the reservoir may include, but are not limited to, a piston, a plunger, and a screw drive.

Figure 2:
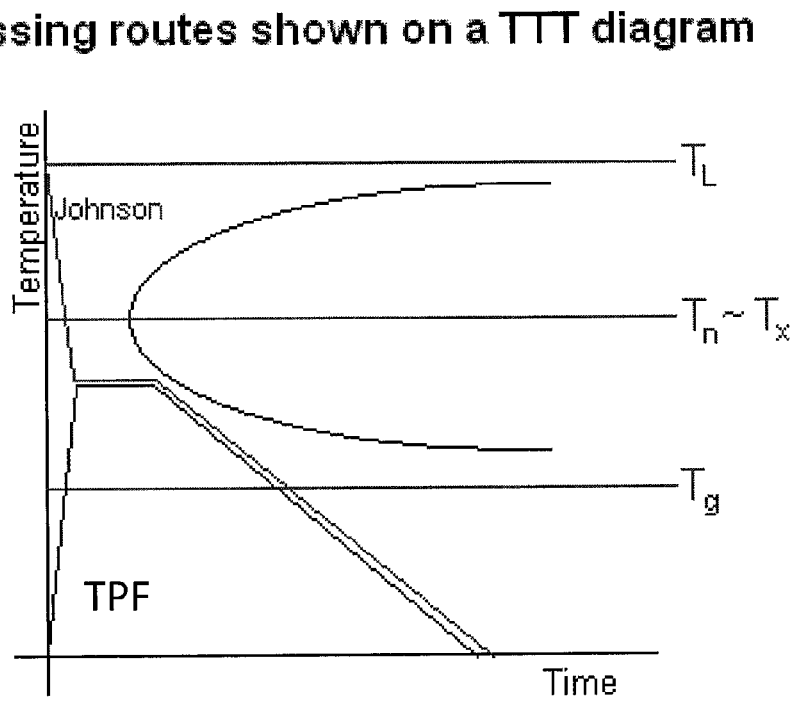
FIG. 2 provides a schematic TTT diagram showing two possible thermoplastic processing routes (Johnson) versus the injection molding processing route (TPF) described in the current invention.
Figure 3:
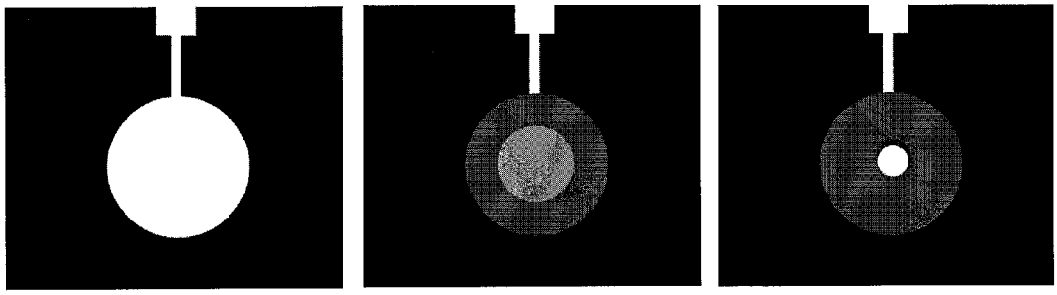
FIG. 3 provides a schematic diagram of a cavitated pore formed during conventional die casting of a bulk part.

Although injection molding is generally considered more complicated to perform than the conventional casting/molding processes described above, there are several significant advantages that make it attractive. For example, the most common method of obtaining metallic glass parts is die casting where the molten alloy is injected into a mold and then cooled below the glass transition temperature sufficiently fast to avoid crystallization. However, die casting requires the molten alloy to be rapidly quenched while being molded in order to effectively bypass crystallization. This processing route thus takes advantage of the thermodynamic stability of the alloy at temperatures above the crystallization nose (the point labeled as $T_n$ in FIG. 2), which provides the temperature $T_n$ at which an alloy has the minimum time to crystallization. However, using such a technique can introduce flow defects into the sample such as micro-cavities, due to high inertial forces in relation to the surface tension forces during the injection of the low viscosity molten liquid. High inertial forces in relation to surface tension forces give rise to a Rayleigh-Taylor instability and consequent flow break-up, resulting in void entrapment. Cavities are also found in the center of die cast parts because parts are vitrified through contact with a mold from the outside in, and cavities nucleate in the center due to the built-up of negative pressure. This phenomenon is shown schematically in FIG. 3. Other undesirable defects can also be found in parts fabricated by the die casting method such as high residual stress concentrations, arising due to a strong coupling between high speed flow and rapid cooling. The flow and cooling requirements of die casting also bound the dimensions of die cast parts to no larger than that which can be cooled sufficiently fast to avoid crystallization and no smaller than that which can be quickly filled. Accordingly, parts with complex geometries, thin sections, and high aspect ratios are difficult to obtain with die casting.

As described above, plastic processing techniques where an amorphous feedstock is heated to a temperature between $T_g$ and $T_x$ and formed under pressure also exist. These methods generally take advantage of the kinetic stability of the alloy at temperatures below the crystallization nose (see, e.g., FIG. 5). Plastic processing also takes advantage of lower processing temperatures resulting in relatively lower oxidation rates These methods include the forming of amorphous metal sheets (see, e.g., U.S. Pat. No. 6,027,586, the disclosure of which is incorporated herein by reference), the compaction of amorphous powders (see, e.g., U.S. Pat. No. 5,209,791, the disclosure of which is incorporated herein by reference), the extrusion of amorphous feedstock into a die (see, e.g., K. S. Lee, Y. W. Chang, 2005, the disclosure of which is incorporated herein by reference), and the imprinting of amorphous metal (see, e.g., Y. Saotome, et al., 2002, the disclosure of which is incorporated herein by reference). While most of these routes reduce the defects of the processed amorphous part, each has other limitations. For example, forming amorphous metal sheets limits the thickness of the final sample and the available part geometries, powder compaction methods usually produce parts having micro- or nano-dispersed porosity that often results in inferior mechanical properties compared to homogenously-solidifying parts, free extrusion, or extrusion into a die only allows parts with simple geometries to be fabricated, and imprinting methods enable very small features to be replicated, but are incapable of producing bulk parts.

The present invention utilizes the ability of the TPF metallic glasses of the current invention to flow homogeneously at temperatures between $T_g$ and $T_x$, to enable pressurized injection of the alloy into a mold to produce a homogenous bulk part with no size restrictions. Another method that utilizes the flow capabilities of metallic glasses between $T_g$ and $T_x$ has been invented by Johnson (See, U.S. Pat. No. 7,017,645, the disclosure of which is incorporated herein by reference). That method involves cooling the molten alloy from above the melting point to a temperature between the crystallization nose and $T_g$, molding at this intermediate temperature, and cooling to ambient temperature. Although this method has similar advantages to the present invention in terms of achievable part geometries and final porosity, Johnson's method requires bypassing the crystallization nose during processing necessitating complicated setups comprising hermetically sealed nozzles and diffusers. Another disadvantage of Johnson's method is the smaller thermal driving force available to quench at an intermediate temperature before processing, as opposed to the current invention where an amorphous feedstock can be quenched to room temperature and later reheated for processing. As a result, Johnson's method necessitates the use of alloys that exhibit high stability against crystallization at $T_n$ whereas the method according to this invention leaves open the possibility of using a broader range of alloys.

The following examples are provided to demonstrate the improved thermoplastic forming properties of the alloys of the instant invention. Specifically tests were performed to investigate the thermal, rheological, and crystallization (Time-Temperature-Transformation (TTT)-diagrams) properties of the inventive material. In summary these studies show that the alloys of the current invention exhibit high yield strength, excellent fracture toughness, and a relatively high Poisson's ratio. In addition, simple micro-replication experiments carried out in open air using relatively low applied pressures demonstrate superior thermoplastic processability for engineering applications.

EXAMPLES

Example 1

Alloy Formation and Properties

Although any suitable alloy formation process may be used to form the materials of the current invention, in the following examples mixtures of elements of purity ranging from 99.9% to 99.99% were alloyed by induction melting on a water cooled copper boat under a Ti-gettered argon atmosphere. Typically 5 g ingots were prepared. Each ingot was flipped over and re-melted at least three times in order to obtain chemical homogeneity.

A Philips X'Pert Pro X-ray diffractometer and a Netzsch 404C differential scanning calorimeter (DSC) (performed at a constant heating rate 0.33 K/s) were utilized to confirm the amorphous natures and to examine the isothermal behaviors in the SCLR of these alloys.

The viscosity of $Zr_{35}Ti_{30}Cu_{7.5}Be_{27.5}$ as a function of temperature in the SCLR was studied using a Perkin Elmer TMA7 in the parallel plate geometry as described by Bakke, Busch, and Johnson. (E. Bakke, R. Busch, W. L. Johnson, *Applied Physics Letters* 1995, 67, 3260, the disclosures of which are incorporated herein by reference.) The measurement was done with a heating rate of 0.667 K/s, a force of 0.02 N, and an initial height of 0.3 mm. The Viscosity and Temperature-Time-Transformation (TTT) diagrams of $Zr_{35}Ti_{30}Cu_{7.5}Be_{27.5}$ at high temperatures were measured in a high vacuum electrostatic levitator (ESL). (See, S. Mukherjee, et al., *Acta Materialia* 2004, 52, 3689; and S. Mukherjee, et al., *Applied Physics Letters* 2004, 84, 5010, the disclosures of which are incorporated herein by reference.) For the viscosity measurements, the resonant oscillation of the molten drop was induced by an alternating current (AC) electric field while holding the sample at a preset temperature. Viscosity was calculated from the decay time constant of free oscillation that followed the excitation pulse.

To determine the top half of the TTT curve, an electrostatically levitated molten (laser melting) droplet (~3 mm diameter) sample was cooled radioactively to a predetermined temperature, and then held isothermally until crystallization. The temperature fluctuations were within ±2 K during the isothermal treatment. For temperatures below the nose of the TTT curve, data was obtained by heating the alloy at 40 K/min in a graphite crucible to the desired temperature and holding the sample isothermally until crystallization.

Using the above techniques studies were performed on the physical properties of alloys in the two "preferred" composition regions of the current invention. As previously discussed, these "preferred" regions include alloys that have compositions in accordance with the following formula: $Zr_aTi_bCu_cBe_d$ (60%<a+b<80%), where in the first region a≈b and d>15%; and where in the second region a≈5b and d>20%

Figure 6:
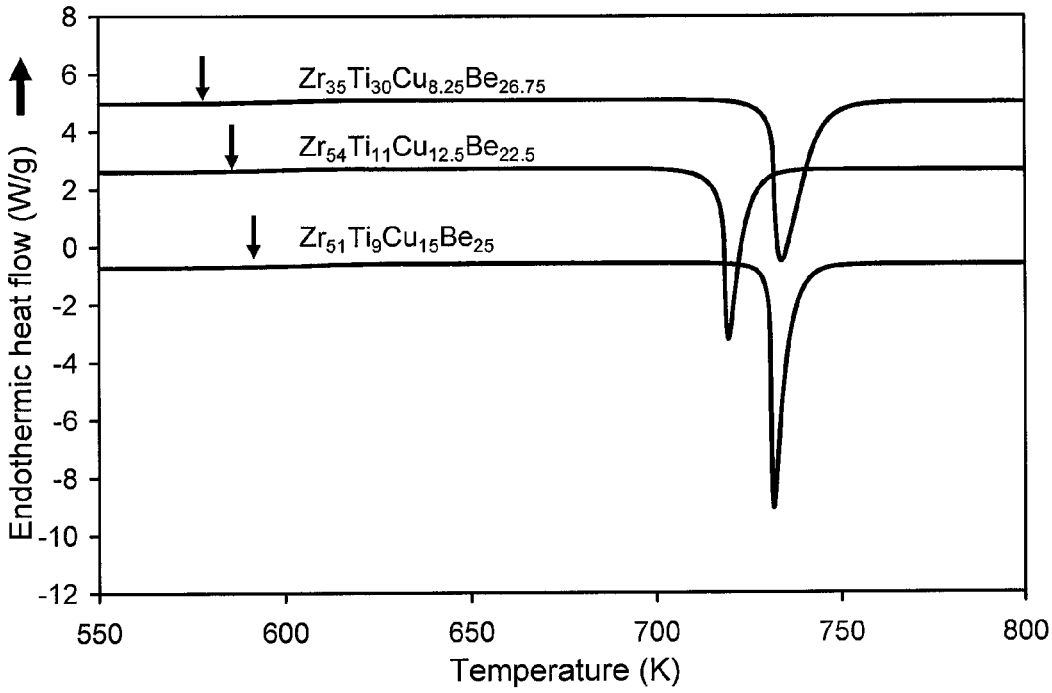
FIG. 6 provides DSC scans of three typical bulk metallic glasses with excellent glass forming ability and extremely high thermal stability in accordance with the current invention.

The differential scanning calorimetry (DSC) curves of three representative alloys of the current invention are presented in FIG. 6. The DSC scans (at a constant heating rate of 0.33 K/s) of three typical metallic glasses with good glass forming ability and high thermal stability against crystallization are presented. The 5-g samples were made in a Ti-gettered silver boat and were generally found to freeze without any crystallization during preparation resulting in a glassy ingot, which suggests that the critical casting thickness of these alloys is at least 1.5 cm. The downward arrows refer to the glass transition temperatures. As shown, the alloys all exhibit a very large SCLR with a single sharp crystallization peak at which the alloy undergoes massive crystallization to a multiphase crystalline product.

The amorphous nature of all the samples studied in this work has been confirmed by X-ray diffraction. A summary of thermal properties of these alloys are listed in Table 2 below, and compared with several earlier reported amorphous alloys.

TABLE 2

Thermal property comparison of various BMG forming alloys.

| Materials | $T_g$ (K) | $T_x$ (K) | $T_l$ (K) | ΔT (K) | $T_g/T_l$ | $T_{TPF}$ |
|---|---|---|---|---|---|---|
| $Zr_{35}Ti_{30}Cu_{7.5}Be_{27.5}$ | 575 | 740 | 1071 | 165 | 0.537 | 600-710 |
| $Zr_{41.2}Ti_{13.8}Ni_{10}Cu_{12.5}Be_{22.5}$ | 623 | 712 | 993 | 89 | 0.627 | 640-690 |
| $Zr_{46.75}Ti_{8.25}Ni_{10}Cu_{7.5}Be_{27.5}$ | 625 | 738 | 1185 | 113 | 0.527 | 650-710 |
| $Pd_{43}Ni_{10}Cu_{27}P_{20}$ | 575 | 665 | 866 | 90 | 0.664 | 600-640 |
| $Pt_{60}Ni_{15}P_{25}$ | 488 | 550 | 804 | 60 | 0.596 | 510-530 |
| $Ce_{68}Cu_{20}Al_{10}Nb_2$ | 341 | 422 | 643 | 81 | 0.530 | 360-400 |
| $Au_{49}Ag_{5.5}Pd_{2.3}Cu_{26.9}Si_{16.3}$ | 401 | 459 | 644 | 58 | 0.623 | 420-440 |
| $Pt_{57.5}Cu_{14.7}Ni_{5.3}P_{22.5}$ | 508 | 606 | 795 | 98 | 0.639 | 530-580 |

References: A. Peker, W. L. Johnson, Applied Physics Letters 1993, 63, 2342; B. Zhang, et al., Physical Review Letters 2005, 94, 205502; T. A. Waniuk, et al., Applied Physics Letters 2001, 78, 1213; H. Kato, et al., Scripta Materialia 2006, 54, 2023; K. Shibata, et al., Progress of Theoretical Physics Supplement 1997, 126, 75; and J. Schroers, et al., Applied Physics Letters 2005, 87, 061912, the disclosures of each of which are incorporated herein by reference.)

The variations of SCLR, ΔT, ($\Delta T=T_x-T_g$, in which $T_x$ is the onset temperature of the first crystallization event) and reduced glass transition temperature $T_{rg}$ ($T_{rg}=T_g/T_l$, where $T_l$ is the liquidus temperature) are calculated. In the alloys of the current invention, $Zr_{35}Ti_{30}Cu_{7.5}Be_{27.5}$ exhibits the lowest $T_g$ (575 K and about 50 K lower than that of Vitreloy 1 or Vitreloy 4) and the largest ΔT. It was further found that the ΔT of the same glass can be maintained at ~165 K by addition of 0.5% Sn, providing the largest SCLR reported for any known bulk metallic glass.

Figure 7:
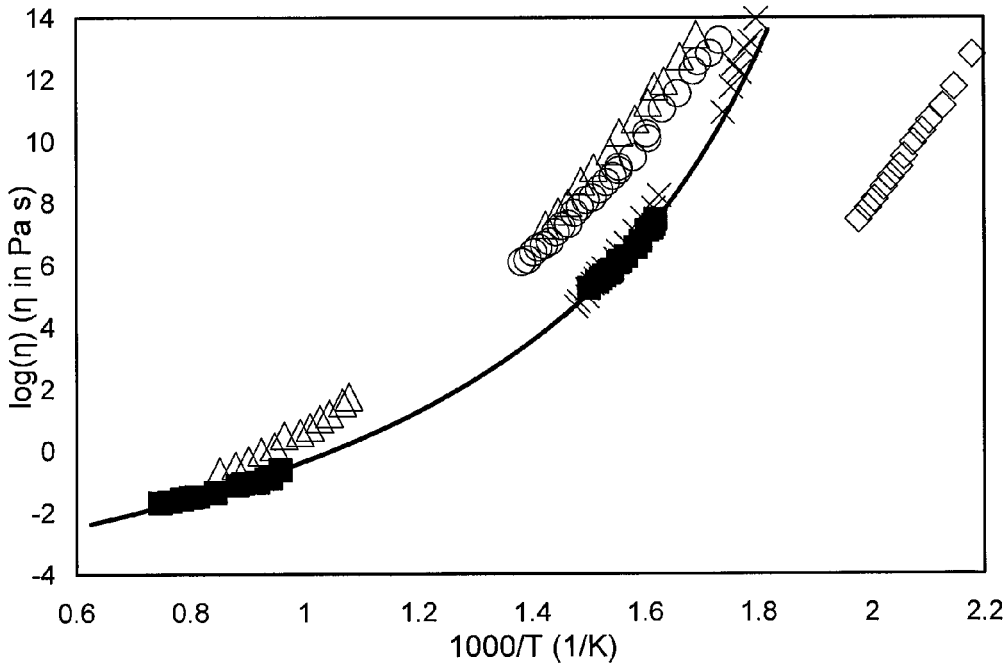
FIG. 7 provides a comparison graph of the temperature dependence of the equilibrium viscosity of several metallic glass forming liquids.

In FIG. 7, the temperature dependence of equilibrium Newtonian viscosity of on exemplary alloy of the current invention ($Zr_{35}Ti_{30}Cu_{7.5}Be_{27.5}$) and several other metallic glass forming liquids are presented. In the figure, the following symbols are used for the different materials: $Zr_{41.2}Ti_{13.8}Ni_{10}Cu_{12.5}Be_{22.5}$ (Vit1) (Δ); $Zr_{46.25}Ti_{8.25}Cu_{7.5}Ni_{10}Be_{27.5}$ (Vit4) [□];$Zr_{35}Ti_{30}Cu_{7.5}Be_{27.5}$ (□); $Pd_{43}Ni_{10}Cu_{27}P_{20}$ (x); and $Pt_{60}Ni_{15}P_{25}$ (◇). The solid curve represents a Vogel-Futcher-Tammann (VFT) fit to the viscosity data of $Zr_{35}Ti_{30}Cu_{7.5}Be_{27.5}$ in accordance with the following equation:

$$\eta = \eta_0 \exp\left(\frac{D^* \cdot T_0}{T - T_0}\right), \quad \text{[EQ. 1]}$$

where $\eta_0$, D*, and $T_0$ are fitting constants. $T_0$ is the VFT temperature and $\eta_0 \approx 10^{-5}$ Pa s. In the best fit, $T_0$=422.6 K and D*=12.4 are found. The alloy in accordance with the current invention shows a viscosity in the thermoplastic zone (570~720 K) that is at least two orders of magnitude lower than that of Vitreloy 1 or Vitreloy 4 at the same temperature and is comparable to that of Pd-based metallic glass, but with a larger ΔT. For example, the equilibrium viscosity at 410° C. for $Zr_{35}Ti_{30}Cu_{7.5}Be_{27.5}$ is measured to be only $6*10^4$ Pa·s, similar to that of viscous polymer melts. (See, F. W. Billmeyer, *Textbook of Polymer Science,* 1984, 305, the disclosure of which is incorporated herein by reference.) As is known from the processing of thermoplastics, the formability is inversely proportional to viscosity. Accordingly, the low viscosity in the SCLR of the TPF alloy of the current invention will result in a low Newtonian flow stress and high formability. Therefore, the present alloys are much more preferable for thermoplastic processing than the traditional Vitreloy 1 series.

Figure 8:
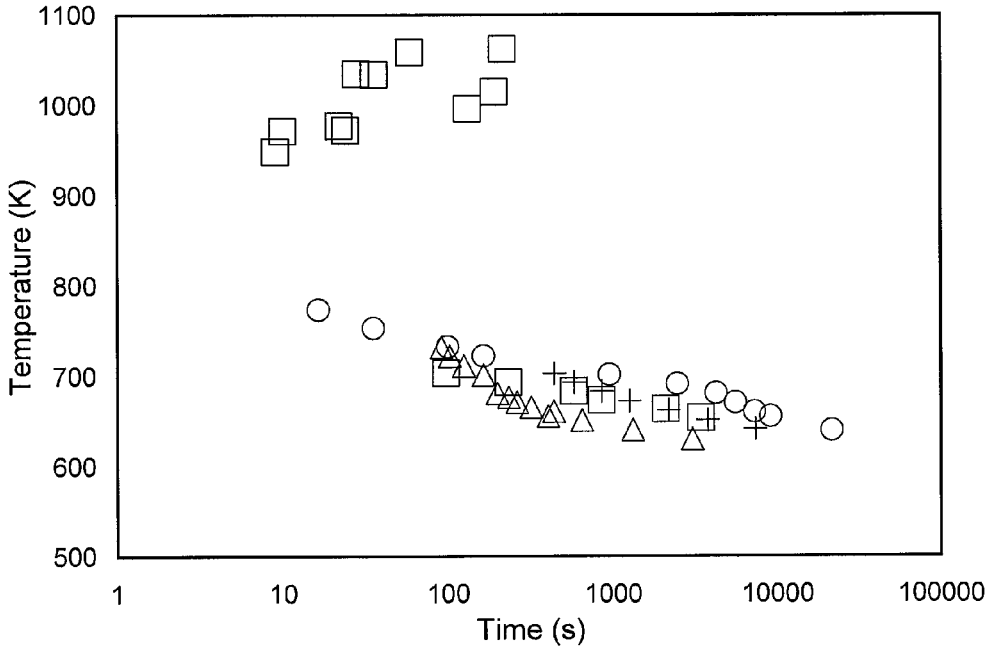
FIG. 8 provides a comparison of TTT diagrams for several amorphous alloys.
Figure 9:
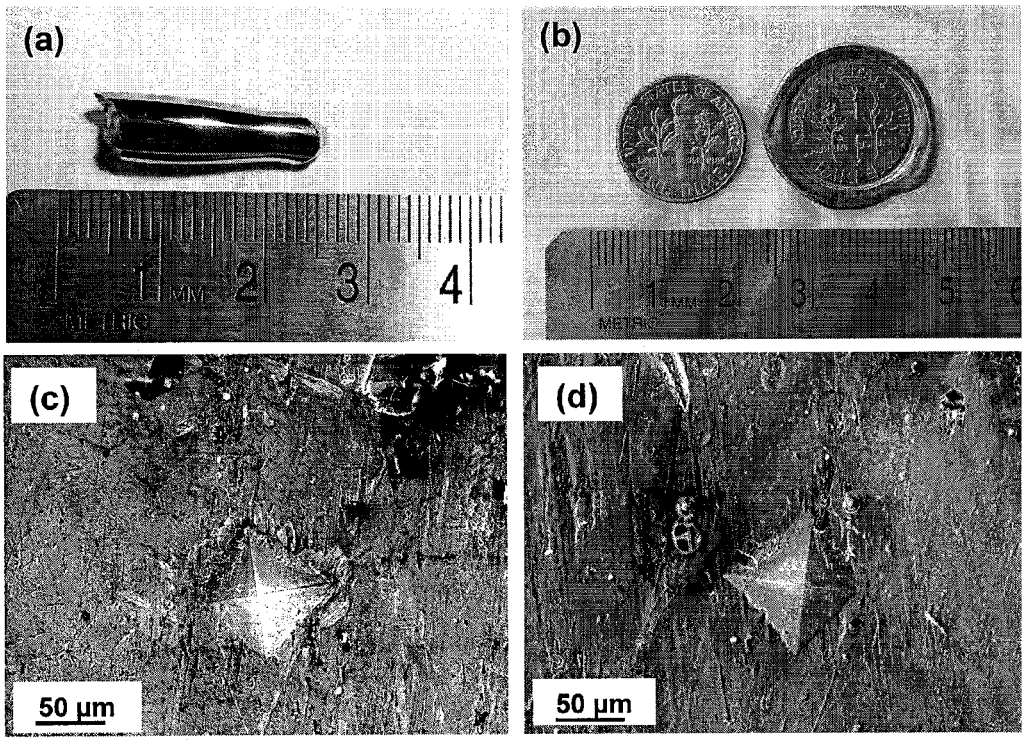
FIG. 9*a* to 9*d* provide photographs of a demonstration of the thermoplastic processability of an exemplary metallic glass in accordance with the current invention.

In FIG. 8, we present the measured TTT curve for $Zr_{35}Ti_{30}Cu_{7.5}Be_{27.5}$ and other Vitreloy series alloys. (T. Waniuk, et al., *Physical Review B* 2003, 67, 184203, the disclosure of which is incorporated by reference.) In the figure, the following symbols are used for the different materials: $Zr_{41.2}Ti_{13.8}Ni_{10}Cu_{12.5}Be_{22.5}$ (Vit1) (x); $Zr_{46.25}Ti_{8.25}Cu_{7.5}Ni_{10}Be_{27.5}$ (Vit4) (*); $Zr_{44}Ti_{11}Cu_{10}Ni_{10}Be_{25}$ (Vit1b) (+)) and the selected $Zr_{35}Ti_{30}Cu_{7.5}Be_{27.5}$ alloy (□ and Δ). The data are measured by electrostatic levitation (□) and by processing in graphite crucibles (other than □) after heating from the amorphous state. The processing window can be identified from this TTT diagram. Specifically, the TTT curve indicates a nose shape, with the minimum crystallization time of ~3-10 s occurring somewhere between 700 K and 950 K. At 680 K, where the equilibrium viscosity is on the order of $10^4$ Pa s, a 600-s thermoplastic processing window is indicated. Based on the curves it can be estimated that the exemplary TPF alloy should have a processing time of about 2 minutes at around 700 K without risking crystallization.

To demonstrate the good thermoplastic processability of the exemplary TPF alloy ($Zr_{35}Ti_{30}Cu_{7.5}Be_{27.5}$) glassy alloy, thermoplastic imprinting experiments were performed as shown in FIGS. 9*a* to 9*d*. The thermoplastic processing was done on a Tetrahedron hot press machine in the air at a pressure of 25 MPa with a processing time of 45 s, followed by a water-quenching step. FIG. 9 shows the microformed impression of a United States dime coin (FIG. 9*b*) made on the surface of metallic glass wafers at ~370° C. (FIG. 9*a*) indicating the excellent imprintability and viscous deformability of the material. In addition, minimal oxidation was observed after the processing which is consistent with the strong oxidation resistance of Be-bearing amorphous alloys. Finally, the final parts remain fully amorphous as verified by X-ray diffraction. It is further found from the Rockwell hardness tests that no damage to the mechanical properties of the alloy was caused by the thermoplastic processing.

Before the TPF was carried out, diamond-shape micro-indentation patterns (~100 μm) were deliberately imprinted into the wafer in the top flame of the dime using a Vickers hardness tester (FIG. 9*c*). FIG. 9*d* presents the successfully replicated diamond pattern in the final part. Even the scratches (on the level of several μm) on the original dime are clearly reproduced. The results indicate a substantial advance in thermoplastic processing of amorphous metals.

Accordingly, the metallic glass forming alloys of the current invention have a combination of properties ideally suited for TPF processes, such as extraordinarily low viscosity in the thermoplastic zone, exceptional thermal stability, very low $T_g$, and excellent GFA. These alloys have also demonstrated strong thermoplastic processability and excellent mechanical properties providing for the possibility of broadening the engineering applications of amorphous metals generally.

Example 2

Injection Molding Application

Figure 10:
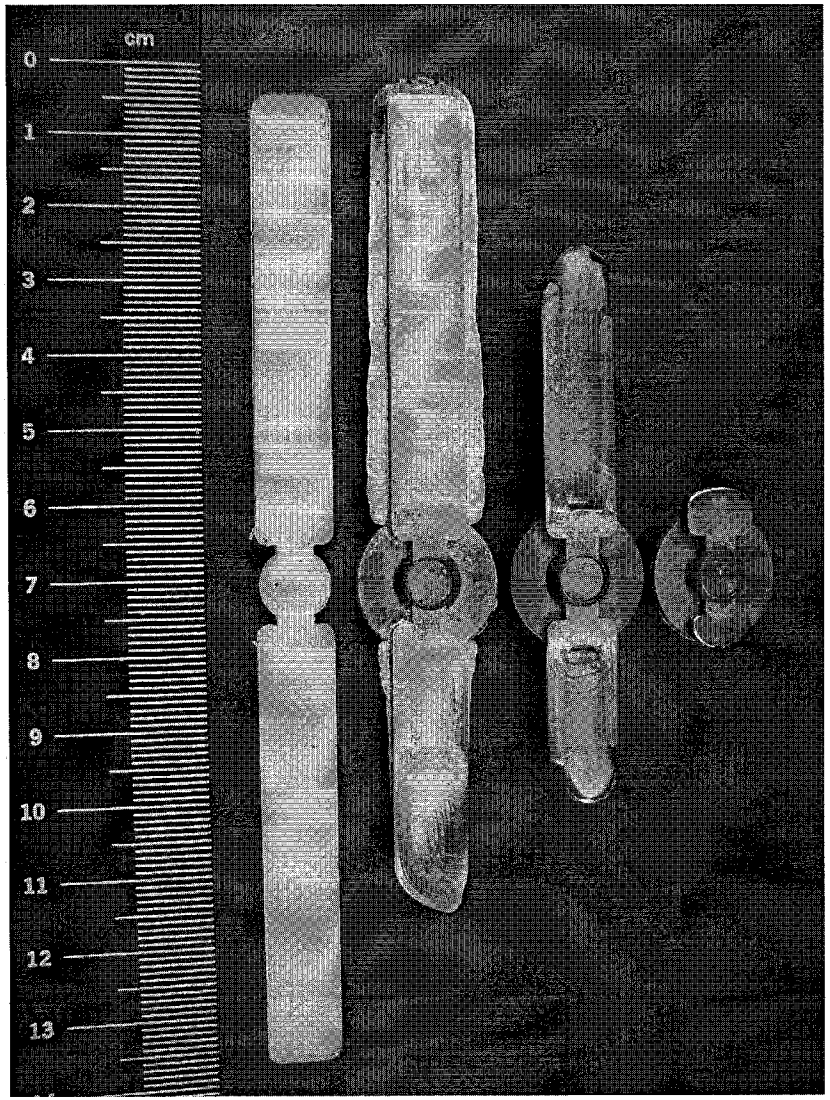
FIG. 10 provides photographs of exemplary injection molded parts in accordance with one embodiment of the thermoplastic processing methodology of the current invention.

As discussed above, the current invention is also directed to novel methods of forming the TPF alloys of the current invention. In FIG. 10 photographs are provided of parts made in accordance with the novel injection molding process disclosed herein next to a polymer part created from the same mold. (From top to bottom: Top Metallic glass $Zr_{35}Ti_{30}Cu_{7.5}Be_{27.5}$ injected at 400 C with 10000 PSI, $2^{nd}$ same glass injected at 380 C with 45000 PSI, $3^{rd}$ same glass injected at 420 C with 45000 PSI, and $4^{th}$ Polymer part injected at 220 C with 5000 PSI, all parts are as cast.) Slight polishing after molding with 320 grit paper removes any oxide layer.

Due to the viscous nature of metallic glasses in the region between $T_g$ and $T_x$, the sprue and nozzle commonly used for plastic injection molding were replaced by a thin washer that acted as a nozzle. The TPF alloy $Zr_{35}Ti_{30}CU_{7.5}Be_{27.5}$, in accordance with the current invention was used as the amorphous feedstock to demonstrate the injection molding process because it provides the largest supercooled liquid region (SCLR) ($T_x$–$T_g$=165 C) of any alloy to date and also the lowest attainable viscosity in the SCLR (~$10^4$ Pa-s) of any known metallic glass. The flashing is 0.1 mm thick and 2.5 mm wide, and was formed mainly due to the lack of adequate clamping force during the process. In this exemplary embodiment both sides of the mold were not filled due to insufficient space in the reservoir for enough material. These final parts demonstrate that a true injection molding process can be used with the TPF alloy materials of the current invention opening up new applications for these alloys in industry.

Figure 11:
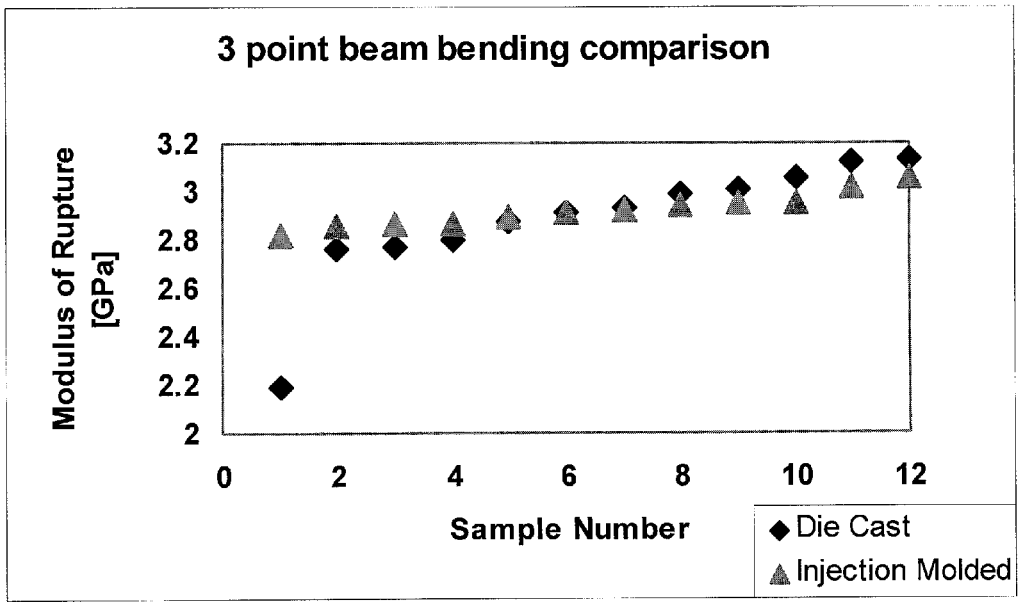
FIG. 11 provides a comparison data graph of the rupture modulus of a die cast piece versus a piece molded in accordance with the injection molding process of the current invention.
Figure 12:
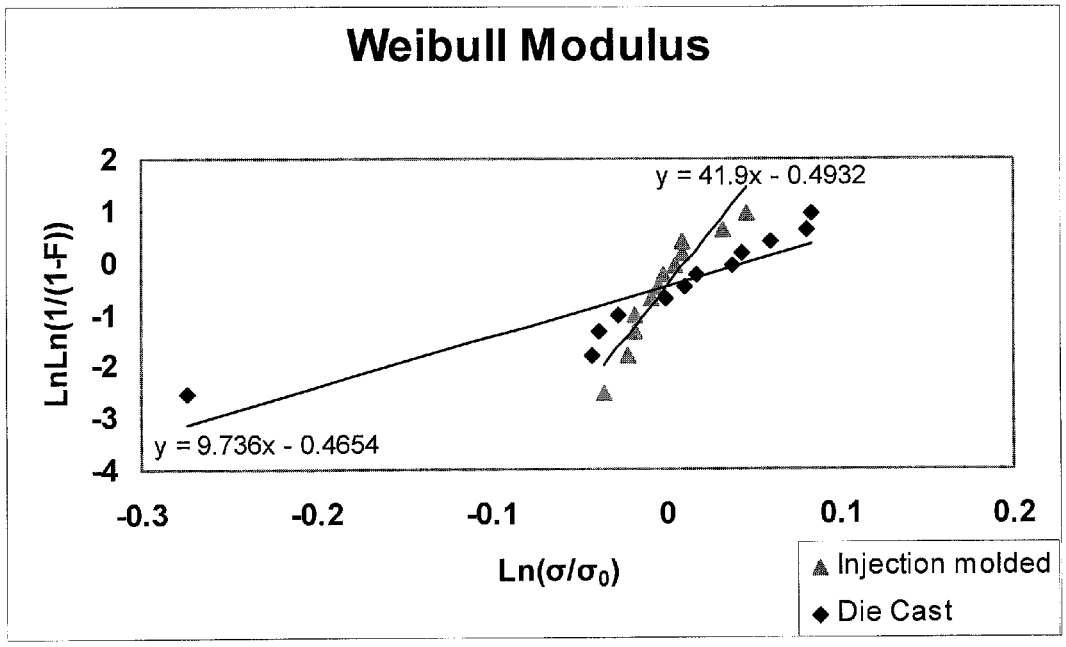
FIG. 12 provides a comparison data graph of the Weibull modulus of a die cast piece versus a piece molded in accordance with the injection molding process of the current invention.

FIG. 11 shows three point beam bending tests of 2 mm×2 mm×20 mm injection molded specimens and die cast specimens of $Zr_{35}Ti_{30}Cu_{7.5}Be_{27.5}$. The average value of the modulus of rupture is nearly equal for both processing methods, but the standard deviation of the modulus of rupture for the cast samples (2.879+/−0.240 GPa) is 3.7 times larger than that of the injection molded specimens 12.923+/−0.065 GPa). FIG. 12 provides a fit of the modulus of rupture data to obtain the Weibull modulus for the injection molded specimens and die cast specimens of $Zr_{35}Ti_{30}Cu_{7.5}Be_{27.5}$. Weibull modulus is basically a measure of the reproducibility of parts. Weibull statistics assume that failure initiates from defects in the sample. Accordingly, samples with low Weibull modulus have high numbers of defects per unit volume. In the current test the injection molded parts made have Weibull modulus value of $m_{IM}$=41.9, while the die cast parts have a Weibull modulus of $m_{DC}$=9.74. As a comparison, high quality engineering ceramics have Weibull modulus values of 1-10, while most metals have Weibull modulus numbers greater than 100.

Both the modulus of rupture test and the Weibull modulus fit are evidence of the improved mechanical properties and reproducibility of fabricated part strengths due to the nearly defect free structures found in parts produced by the injection molding technique of the current invention.

SUMMARY

In summary, a new class of high strength, thermoplastically processable amorphous alloys having low density, viscosities in the thermoplastic zone at least two orders of magnitude lower than that of the commercialized Zr-based alloys and similar to the viscosity of Pd-based metallic glass and polymer glasses, unusually high thermal stability, low $T_g$, and excellent glass forming ability (critical casting thickness ~15 mm) have been discovered. In addition, an injection molding technique has been developed to allow processors to take full advantage of the unique properties of these materials The technological potential of this class of glassy alloys and the injection molding technique is very promising in a wide-variety of applications including, for example, aerospace and astrospace components (Ribs, spars, airframes, space structures), defense (Armor plating, weapons), sporting goods (tennis rackets, baseball bats, golf clubs), structural components (frames, casings, hinges), automotive components, foam structures, nano- and microtechnology, medical and optical applications, data storage, and microelectromechanical systems.

Finally, it should be understood that while preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A thermoplastically processable bulk solidifying amorphous alloy having a composition in accordance with the equation:

$$(Zr_xTi_{(1-x)})_{a1}ETM_{a2}Cu_{b1}LTM_{b2}Be_c,$$

where (ETM) comprises the group of Early Transition Metals, (LTM) comprises the group of Late Transition Metals;

where x is an atomic fraction and a1, a2, b1, b2, and c are atomic percentages, and where (a1+a2) falls within the range of 60 to 80%, x is in the range of 0.05 to 0.95, (b1+b2) is in the range of 2 to 17.5%, c is at least 15%, and Ni comprises no greater than 5% of the overall composition; and where the alloy has a supercooled liquid region (ΔT) defined as the temperature difference between the glass transition temperature and crystallization temperature of the alloy of at least 135 K and a viscosity within this supercooled liquid region that falls below a value of less than about $10^5$ Pa-s when measured at a heating rate of 20 K/min.

2. The thermoplastically processable bulk solidifying amorphous alloy of claim 1, wherein the alloy has a composition in accordance with the following equation:

$$Zr_aTi_bCu_cBe_d; \text{ and}$$

wherein a, b, c, and d are atomic percentages, a+b is within the range of 60 to 80%, and d is greater than or equal to 15%.

3. The thermoplastically processable bulk solidifying amorphous alloy of claim 2, wherein a is approximately equal to five times b and d is greater than or equal to 20%.

4. The thermoplastically processable bulk solidifying amorphous alloy of claim 2, wherein a is approximately equal to b.

5. The thermoplastically processable bulk solidifying amorphous alloy of claim 1, wherein the atomic percent of Zr and Ti is in the range of from about 60 to 75%.

6. The thermoplastically processable bulk solidifying amorphous alloy of claim 1, further comprising up to 5% of at least one additional material.

7. The thermoplastically processable bulk solidifying amorphous alloy of claim 6, wherein the additional material is selected from the group consisting of tin, boron, silicon, aluminum, indium, germanium, gallium, lead, bismuth, arsenic and phosphorous.

8. The thermoplastically processable bulk solidifying amorphous alloy of claim 1, further comprising up to 15% of at least one additional early transition metal.

9. The thermoplastically processable bulk solidifying amorphous alloy of claim 1, wherein the early transition metal is selected from the group consisting of chromium, hafnium, vanadium, niobium, yttrium, neodymium, gadolinium and other rare earth elements, molybdenum, tantalum, and tungsten.

10. The thermoplastically processable bulk solidifying amorphous alloy of claim 1, further comprising up to 15% of at least one additional late transition metal.

11. The thermoplastically processable bulk solidifying amorphous alloy of claim 1, wherein the early transition metal is selected from the group consisting of manganese, iron, cobalt, ruthenium, rhodium, palladium, silver, gold, and platinum.

12. The thermoplastically processable bulk solidifying amorphous alloy of claim 1, wherein the alloy has an amorphous phase that comprises greater than 25% of the alloy by volume.

13. The thermoplastically processable bulk solidifying amorphous alloy of claim 1, wherein the alloy has an amorphous phase that comprises greater than 90% of the alloy by volume.

14. The thermoplastically processable bulk solidifying amorphous alloy of claim 1, wherein the alloy has a density of around 5.5 g/cm$^3$.

15. The thermoplastically processable bulk solidifying amorphous alloy of claim 1, wherein the alloy has a supercooled liquid region of greater 140 K when measured at a heating rate of 20 K/min.

16. The thermoplastically processable bulk solidifying amorphous alloy of claim 1, wherein at a heating rate of 20 K/min the alloy attains a viscosity in the supercooled liquid region of lower than $10^4$ Pa-s.

17. The thermoplastically processable bulk solidifying amorphous alloy of claim 1, wherein the alloy has a critical cooling rate of less than $10^6$ K/s.

18. The thermoplastically processable bulk solidifying amorphous alloy of claim 1, wherein the alloy has a critical cooling rate of less than $10^3$ K/s.

19. The thermoplastically processable bulk solidifying amorphous alloy of claim 1, wherein the composition has a ΔT of at least 160 K and is selected from the group consisting of $Zr_{35}Ti_{30}Cu_{7.5}Be_{27.5}$, $Zr_{37.5}Ti_{25}Cu_{10}Be_{27.5}$, and $Zr_{40}Ti_{25}Cu_{10}Be_{25}$.

20. The thermoplastically processable bulk solidifying amorphous alloy of claim 1, wherein the alloy has a critical casting thickness of greater than 1 mm.

21. The thermoplastically processable bulk solidifying amorphous alloy of claim 1, wherein the alloy has a critical casting thickness of greater than 15 mm.

22. A thermoplastically processable bulk solidifying amorphous alloy having a composition in accordance with the equation:

$$(Zr_xTi_{(1-x)})_{a1}ETM_{a2}Cu_{b1}LTM_{b2}Be_c,$$

where (ETM) comprises the group of Early Transition Metals, (LTM) comprises the group of Late Transition Metals;

where x is an atomic fraction and a1, a2, b1, b2, and c are atomic percentages, and where (a1+a2) falls within the range of 60 to 75%, x is in the range of 0.50 to 0.85, (b1+b2) is in the range of 2 to 17.5%, c is in the range of 17.5 to 33%, and Ni comprises no greater than 5% of the overall composition; and where the alloy has a supercooled liquid region (ΔT) defined as the temperature difference between the glass transition temperature and crystallization temperature of the alloy of at least 135 K and at a heating rate of 20 K/min has a viscosity within this supercooled liquid region that falls below a value of less than about $10^5$ Pa-s.

23. The thermoplastically processable bulk solidifying amorphous alloy of claim 22, wherein the alloy has a composition in accordance with the following equation:

$$Zr_aTi_bCu_cBe_d; \text{ and}$$

wherein a, b, c, and d are atomic percentages, a+b is within the range of 60 to 65%, c is in the range of 5 to 17.5%, and d is in the range of 17.5 to 32%.

24. The thermoplastically processable bulk solidifying amorphous alloy of claim 23, wherein a is approximately equal to five times b and d has a lower limit of 20%.

25. The thermoplastically processable bulk solidifying amorphous alloy of claim 22, further comprising up to 5% of at least one additional material.

26. The thermoplastically processable bulk solidifying amorphous alloy of claim 25, wherein the additional material is selected from the group consisting of tin, boron, silicon, aluminum, indium, germanium, gallium, lead, bismuth, arsenic and phosphorous.

27. The thermoplastically processable bulk solidifying amorphous alloy of claim 22, wherein the early transition metal is selected from the group consisting of chromium, hafnium, vanadium, niobium, yttrium, neodymium, gadolinium and other rare earth elements, molybdenum, tantalum, and tungsten.

28. The thermoplastically processable bulk solidifying amorphous alloy of claim 22, wherein the late transition metal is selected from the group consisting of manganese, iron, cobalt, ruthenium, rhodium, palladium, silver, gold, and platinum.

29. The thermoplastically processable bulk solidifying amorphous alloy of claim 22, wherein the composition has a ΔT of at least 160 K and is selected from the group consisting of $Zr_{37.5}Ti_{25}Cu_{10}Be_{27.5}$, $Zr_{40}Ti_{25}Cu_{10}Be_{25}$, and $Zr_{35}Ti_{30}Cu_{7.5}Be_{27.5}$.

* * * * *

UNITED STATES PATENT AND TRADEMARK OFFICE

CERTIFICATE OF CORRECTION

PATENT NO. : 7,794,553 B2
APPLICATION NO. : 11/952694
DATED : September 14, 2010
INVENTOR(S) : Gang Duan et al.

It is certified that error appears in the above-identified patent and that said Letters Patent is hereby corrected as shown below:

Column 15, line 17 (claim 10), delete “early” and insert --late--

Column 16, line 47 (claim 28), delete “early” and insert --late--

Signed and Sealed this
Twenty-second Day of March, 2011

David J. Kappos

David J. Kappos
*Director of the United States Patent and Trademark Office*